United States Patent [19]

Rebsamen

[11] 4,135,346

[45] Jan. 23, 1979

[54] APPARATUS FOR CONTROLLING THE SPEED OF A PACKAGING MACHINE

[75] Inventor: August Rebsamen, Neuhausen am Rheinfall, Switzerland

[73] Assignee: SIG Schweizerische Industrie-Gesellschaft, Rheinfall, Switzerland

[21] Appl. No.: 837,411

[22] Filed: Sep. 28, 1977

[30] Foreign Application Priority Data

Oct. 6, 1976 [CH] Switzerland ..... 12642/76

[51] Int. Cl.[2] ..... B65B 57/16

[52] U.S. Cl. ..... 53/494

[58] Field of Search ..... 53/52, 59 R, 77

[56] References Cited

U.S. PATENT DOCUMENTS 2,977,731 4/1961 Brook et al. ..... 53/59 R X 3,248,844 5/1966 Cross et al. ..... 53/59 R X

*Primary Examiner*—Travis S. McGehee

*Attorney, Agent, or Firm*—Spencer & Kaye

[57] ABSTRACT

Apparatus for controlling the speed of operation of a machine for packaging objects, such as cookies, in groups, in order to assure a sufficient supply of objects to the machine while preventing an undue accumulation of objects in front of the machine intake. The apparatus includes sensors providing signals indicating the passage of objects past selected points along the input path to the machine. It also includes a signal processor for receiving those signals and producing output signals which act to stop the machine when an insufficient number of objects is present in front of the machine intake and to increase the machine processing speed when the accumulation of objects in front of the machine intake increases above a selected magnitude.

8 Claims, 5 Drawing Figures

APPARATUS FOR CONTROLLING THE SPEED OF A PACKAGING MACHINE

BACKGROUND OF THE INVENTION

The present invention relates to machines for packaging objects, such as cookies and particularly to apparatus for controlling the speed of operation of such machines. When controlling the speed of a packaging machine, care must be taken that the objects to be packaged, which are generally furnished by a source which is subject to fluctuations in its output rate, are fed into the machine in such a way that they are positively gripped by the machine and subsequently packaged. For this purpose it is necessary for the objects to accumulate to some extent on the input path to the machine so that they will be available at its entrance in immediate succession, i.e. in uninterrupted sequence.

The objects being packaged may be, for example, delicate cookies and in order to prevent the development of unduly high pressures which could damage such objects, the number of objects which can accumulate should be limited. In order to accomplish this, the speed of the packaging machine must be adapted to the output of the source.

The source may also not be providing any objects, i.e. have no output at all, as may occur, for example, at the end of a production shift or as a result of a malfunction. In this case, the packaging machine must be stopped and restarted after production resumes or after elimination of the malfunction.

The speed of the packaging machine is often adapted manually in a very simple manner by observing the length of the accumulation on the input path and if it is more or less than a given length, the speed of the packaging machine is increased or decreased by means of a manual control.

To avoid the labor expenses which such regulation requires, an apparatus has been developed to control the speed of a packaging machine with the aid of sensors which are disposed along the input paths for the machine for the purpose of determining whether or not an uninterrupted series of objects to be packaged is present at certain points along this path. The rate of rotation of the motor driving the machine is then controlled in steps in dependence on the sensor signals so that over the operating range of the machine all objects introduced to it at a fluctuating feeding speed are permitted to accumulate to a certain extent in front of the machine and are then packaged by the machine at a rate, and with a rhythm, determined by its speed.

This known control apparatus has the drawbacks that it is rather complicated and nevertheless provides insufficiently rapid adaptation of the machine speed to changes in the rate of delivery of objects. Three sensors are required and the speed is adjusted only to two limit values, i.e. to an upper limit value when the length of accumulation has reached a given maximum, and to a lower limit value when it has reached a given minimum. This results in considerable undesirable fluctuations in the accumulation pressure.

SUMMARY OF THE INVENTION

It is an object of the present invention to eliminate such drawbacks.

A more specific object of the invention is to improve the reliability of the feeding of objects to a packaging machine.

A further specific object of the invention is to prevent an excessive accumulation of objects at the intake of such a machine.

A still further specific object of the invention is to optimize the operating speed of the packaging machine as a function of the rate of delivery of objects thereto.

Yet a further object of the invention is to simplify the control device required to achieve such results.

These and other objects are achieved according to the present invention by provision of a first sensor disposed at a first location on a first conveying means which transports the object at a constant speed, a second sensor disposed at a second location between the first location and the machine, and control circuitry connected to derive a control signal from the signals furnished by the first sensor, which control signal is fed or not fed to a speed controller in dependence on a signal from the second sensor to selectively cause the motor to run at a speed almost proportional to the control signal or to stop.

DESCRIPTION OF THE PREFERRED EMBODIMENTS

Figure 1:
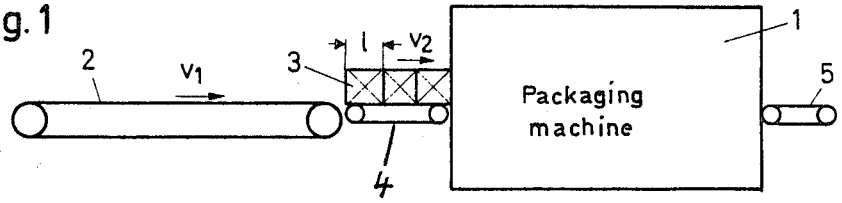
FIG. 1 is a simplified pictorial elevational view of a packaging machine and associated feeder means equipped with a control system according to the invention.

Referring first to FIG. 1, the control device serving to control the speed of a packaging machine 1 includes an endless input conveyor belt 2 which is driven at a constant speed $v_1$ by a motor (not shown). If each of the objects 3 to be packaged has a length l and the machine 1 has a maximum processing rate $n_{max}$, where n represents the number of objects processed per unit time, then $v_1 > l \cdot n_{max}$, e.g. $v_1 = (1.1 \text{ to } 3.5)\, l \cdot n_{max}$.

The first endless belt 2 is followed by a second endless feeder belt 4 which is driven by the packaging machine 1 at a speed $v_2$ which is proportional to its rate n but less than $v_1$. An endless belt 5 which is also driven by the packaging machine 1 is provided at the outlet of machine 1.

Figure 2:
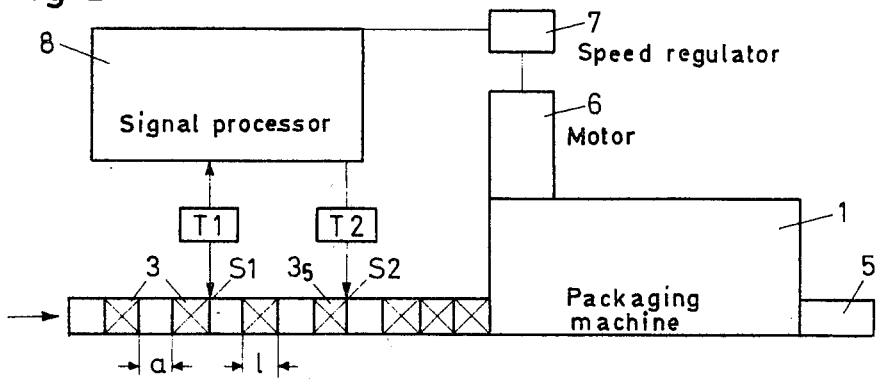
FIG. 2 is a plan view of FIG. 1 showing one embodiment of the control system.

Referring to FIG. 2, the packaging machine 1 is driven by an electric motor 6 which is controlled by a speed regulator 7 of conventional type through a signal processor 8. The signal processor 8 has its input connected to two sensors T1 and T2 which form, for example, parts of light barriers that determine photoelectrically whether an object is present or not at each of two predetermined points S1 and S2, respectively, on the input path for the objects. Point S1 is disposed on the path of the first feeder belt 2 and point S2 is disposed between point S1 and the packaging machine 1. In the present case, S2 is disposed approximately at the end of the first feeder belt 2, but it could instead also be disposed on the path of the second feeder belt 4, particularly at its beginning.

The light barrier sensor T1 is designed so that it generates a positive square wave signal $s_1$, as shown in FIG.

5, upon the passage of a single object 3 through its sensing zone. Light barrier sensor T2 is identical to sensor T1. Since, however, the objects 3 normally pass point S2 not individually but in contact with one another, the signal $s_2$ furnished by sensor T2, as shown in FIG. 5, is a continuous signal of fixed amplitude.

Figure 5:
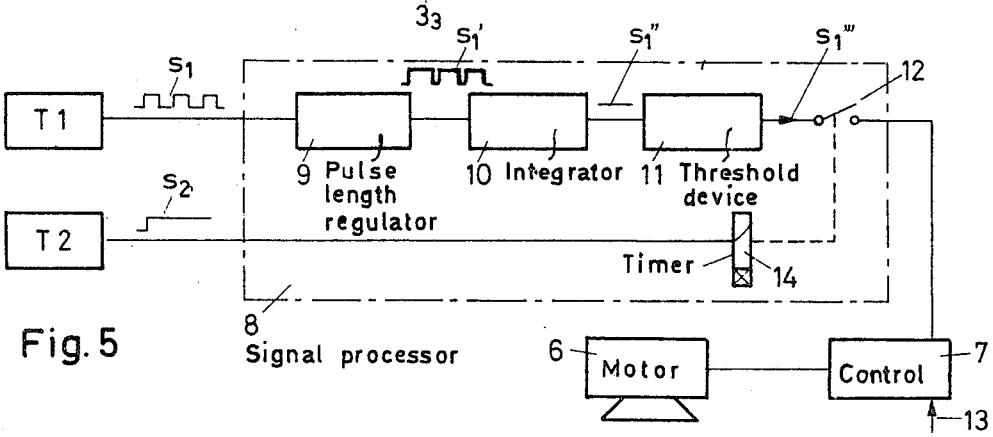
FIG. 5 is a detailed schematic illustration of a preferred embodiment of a signal processor of a system according to the invention.

According to FIG. 5, the signal processor 8 includes a pulse length regulator 9 which receives the signals $s_1$ furnished by sensor T1 and which can increase or decrease the length of these pulses. The output pulses $s_1'$ from pulse length regulator 9, which have been, for example, extended somewhat, are fed to a pulse integrator 10 which integrates the received pulses and thus produces a direct voltage $s_1''$ whose amplitude is proportional to the number, or repetition rate, of received pulses $s_1'$ and to the length of these pulses. The direct voltage $s_1''$ is fed to a threshold value device 11 which provides an output signal $s_1'''$ to the speed regulator 7 of motor 6 only if the direct voltage $s_1''$ exceeds a certain, preferably settable threshold value, and if a contact 12 is closed.

When speed regulator 7 receives the signal $s_1'''$, it connects a high-voltage feeder line 13 to the motor 6 and regulates the speed of motor rotation in a known manner to a value which increases with the magnitude of signal $s_1'''$. Contact 12 is a contact of a delayed turn-off relay 14 of known type having a delayed turn-off, or opening, which can be set, for example, between 1 and 5 seconds. Relay 14 is fed with the output signal $s_2$ of sensor T2.

The described control device is intended to provide an appropriate increase or reduction in the number of objects fed to the packaging machine 1 per unit time in a manner to assure that the objects do not accumulate too much on the input path or do not reach the machine only individually and not in the operating rhythm of the machine, whereupon it would no longer operate dependably. In this case it must be considered that the rate at which objects are furnished is not constant but fluctuates considerably about a mean value. The objects 3 may be, for example, cookies or pieces of chocolate so that care must be taken that adjacent objects are not compressed too much, as this would damage them.

The control device according to the invention satisfies these conditions as follows:

Since the speed $v_1$ of the feeder belt 2 is greater than $l \cdot n_{max}$, and $n_{max}$ corresponds, of course, to the maximum output of the producer of the objects 3, for example a cookie oven, the objects 3 practically always have a certain spacing "a" between one another when passing point S1. That in FIGS. 2–4 this spacing "a" is shown as being constant and equal to the length "l" of an object is the result only of a simplification of the drawing. Sensor T1 therefore furnishes a series of pulses $s_1$ to pulse length regulator 9.

If it is initially assumed that regulator 9 is set so that the pulse length remains unchanged at a value proportional to l the pulse integrator 10 produces a direct voltage output signal $s_1''$ with an amplitude which corresponds to the drive power being supplied to belt 2. If signal $s_1''$ exceeds the threshold value of device 11, a signal $s_1'''$ is fed via contact 12, which is assumed to then be closed, to speed regulator 7 so as to impart a rate of rotation to motor 6 which is approximately proportional to the amplitude of this signal $s_1'''$. If the feeding power to belt 2 is relatively high, as will be the case in the normal operating range, the threshold value does become a factor, i.e. signal $s_1''$ continuously exceeds the threshold value, so that the speed of the motor remains practically proportional to this feeding power.

The proportionality factor may here be adjusted by adjusting the pulse length regulator 9 because if the pulses $s_1'$ are made longer or shorter, respectively, than pulses $s_1$, integrator 10 furnishes a voltage $s_1''$ which is correspondingly higher or lower, respectively, which results in a higher or lower, respectively, rate of rotation for motor 6 and speed of operation of the packaging machine 1. If, on the one hand, individual incoming objects 3 have accumulated on belt 4 up to point S2 and thus contact 12 is closed and if, on the other hand, the pulses from sensor T1 have exceeded the set value of threshold value 11, the motor 6 is started.

If the accumulation of objects extends back to point S1, the light barrier T1 is continuously interrupted by the last objects $3_1$, $3_2$ (FIG. 3) reaching S1, which results in a constant signal $s_1'$ and thus a maximum value of the direct voltage $s_1''$, which produces the maximum rate of rotation of the motor.

If the power being supplied to belt 2 becomes so low that the accumulation no longer extends to sensor T2, contact 12 will open after the delay time of relay 14 so that motor 6 is stopped.

Figure 4:
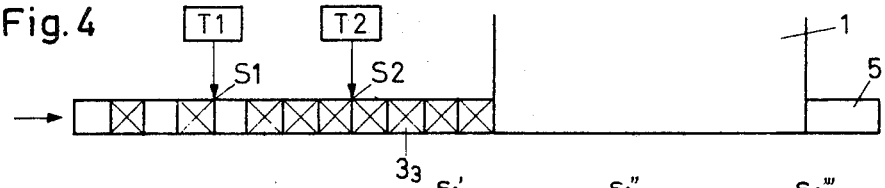

In order for contact 12 to again become closed, relay 14 must be excited by signal $s_2$, i.e. the light barrier of sensor T2 at S2 must be interrupted as shown in FIG. 4, which shows an operating state in which a sufficient number of objects $3_3$ has accumulated between point S2 and the packaging machine 1 to assure that the same are properly gripped and packaged by the machine in the machine rhythm.

Figure 3:
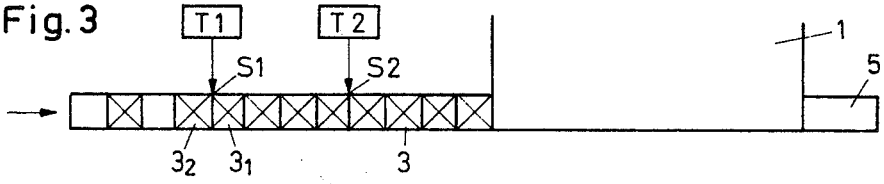
FIGS. 3 and 4 are plan views of a portion of the apparatus of FIG. 2 illustrating two different input states.

Despite the very well approximated uniformity between the feeding output of belt 2 and the speed of the machine, the number of accumulated objects may increase to extend somewhat beyond S1, as is shown in FIG. 3. However, if the pulse length regulator 9 is correctly set, which may require some trial and error for any given machine, the accumulation beyond S2 will reach point S1 only in exceptional cases. When this occurs, motor 6 again reaches its maximum speed, which will cause this accumulation to be reduced.

Time-delay relay 14 with contact 12 operates with a delay so that operation of motor 6 is not interrupted immediately when one or a plurality of objects $3_5$ arrive at point S2 with some delay, as shown in FIG. 2, constituting a situation in which the accumulation is still present at the machine inlet but no longer extends quite to point S2.

The above-described apparatus is able to operate with a high output of, for example, about 400 objects per minute with very slight fluctuations in the accumulation pressure. The apparatus is less complicated and operates more accurately and carefully than the prior art control devices having three sensing devices.

It should also be noted that, instead of photoelectric sensors, it is also possible to provide sensors of a different type, particularly sensors which likewise operate without contact, such as capacitive sensors or ultrasonic sensors. Instead of endless belts 2, 4, endless chains or circular cables or vibratory plates can be provided.

It will be understood that the above description of the present invention is susceptible to various modifications, changes and adaptations, and the same are intended to be comprehended within the meaning and range of equivalents of the appended claims.

What is claimed is:

1. A system for controlling the operating speed of a machine for packaging objects, said machine being driven by a motor and having an intake for receiving said objects and input conveying means for transporting said objects along an input path to said machine intake, said system comprising a first sensor disposed at a first selected point along said input conveying means, a second sensor disposed at a second selected point along said input path between said first point and said machine intake, said first and second sensors providing signals indicating the presence or absence of an uninterrupted series of said objects to be packaged at selected points along said input path and being the only such sensors provided for control of the operating speed of said machine, motor control means for regulating the speed of said motor in dependence on signals provided by said first and second sensors so as to permit objects which are supplied to said input conveyor at a fluctuating rate to accumulate ahead of said machine intake and to then be packaged in said machine at a rate determined by the operating speed of said machine, and a signal processor, said signal processor comprising signal deriving means coupled to said first sensor for deriving a control signal from the signal provided by said first sensor, and signal delivery control means coupled to said signal deriving means for selectively delivering said control signal to said motor control means in dependence on the signal provided by said second sensor, said control signal causing said motor to either be driven at a speed approximately proportional to the value of said control signal or to be stopped.

2. An arrangement as defined in claim 1 wherein said signal processor is provided with two inputs each connected to receive the signals produced by a respective one of said sensors and an output connected to said motor control means, said first sensor produces a signal pulse in response to the passage of each object by the first selected point, said signal deriving means comprise a series connection of a pulse length regulator connected to that one of said inputs which receives the signals from said first sensor, a pulse integrator, and a threshold device for producing a signal constituting the control signal and proportional to the output signal from said integrator whenever said integrator output signal exceeds a predetermined value, and said signal delivery control means comprise a time delay relay connected to be actuated by the signal delivered to the other one of said inputs by said second sensor and provided with switchable contacts connected in series between the output of said threshold device and said motor control means.

3. An arrangement as defined in claim 2 wherein said pulse length regulator serves to adjust the relationship between the conveying speed of said first conveyor and the operating speed of the machine, and said pulse integrator operates to integrate the pulses received during a certain time interval from said pulse length regulator and furnishes a direct voltage to said threshold device.

4. An arrangement as defined in claim 2 wherein said relay has an adjustable time delay.

5. An arrangement as defined in claim 1 wherein said sensors operate without contacting the objects.

6. An arrangement as defined in claim 5 wherein said sensors are photoelectric, capacitive, or ultrasonic sensors.

7. An arrangement as defined in claim 1 wherein said input conveying means comprises first and second conveyors, said second conveyor being disposed between said first conveyor and said machine intake, the speed of said first conveyor being equal to 1.1 to 3.5 times the product of the length in the conveying direction of each object to be packaged and the maximum object packaging rate of said machine.

8. An arrangement as defined in claim 7 wherein said second conveyor conveys objects at a speed lower than that of said first conveyor.

* * * * *